US007798777B2

(12) United States Patent
Moussa et al.

(10) Patent No.: US 7,798,777 B2
(45) Date of Patent: Sep. 21, 2010

(54) ENGINE COMPRESSOR ASSEMBLY AND METHOD OF OPERATING THE SAME

(75) Inventors: Zaher Milad Moussa, Salem, MA (US); Caroline Curtis Granda, Salisbury, MA (US); Robert Albert Walter, Glendale, AZ (US)

(73) Assignee: General Electric Company, Schenectady, NY (US)

( * ) Notice: Subject to any disclaimer, the term of this patent is extended or adjusted under 35 U.S.C. 154(b) by 553 days.

(21) Appl. No.: 11/611,558

(22) Filed: Dec. 15, 2006

(65) Prior Publication Data

US 2008/0145213 A1 Jun. 19, 2008

(51) Int. Cl.
*F03D 11/00* (2006.01)

(52) U.S. Cl. ..... 416/183; 415/207

(58) Field of Classification Search ..... 415/182.1, 415/207, 222, 220, 203, 206, 212.1; 416/182, 416/183, 185

See application file for complete search history.

(56) References Cited

U.S. PATENT DOCUMENTS

| | | | | |
|---|---|---|---|---|
| 2,990,106 | A * | 6/1961 | Craig | 415/194 |
| 3,904,308 | A * | 9/1975 | Ribaud | 415/143 |
| 4,060,337 | A | 11/1977 | Bell, III | |
| 4,428,715 | A | 1/1984 | Wiggins | |
| 6,585,482 | B1 | 7/2003 | Liotta et al. | |
| 6,857,845 | B2 | 2/2005 | Stabley et al. | |
| 7,021,891 | B2 | 4/2006 | Sanchez et al. | |

FOREIGN PATENT DOCUMENTS

JP 06066292 A * 3/1994

OTHER PUBLICATIONS

William J. McNally, III, Prepared by Pratt & Whitney Aircraft Division, United Aircraft Coporation, Florida Research and Development Center, West Palm Beach, Florida, "10:1 Pressure Ratio Single-Stage Centrifugal Compressor Program, " USAA MRDL technical Report 74-15, Apr. 1974, 33 pgs. (a portion of).

(Continued)

*Primary Examiner*—Edward Look
*Assistant Examiner*—Dwayne J White
(74) *Attorney, Agent, or Firm*—William Scott Andes, Esq.; Armstrong Teasdale LLP

(57) ABSTRACT

A compressor assembly for a gas turbine engine is provided. The compressor assembly includes a rotating impeller including an inlet, an outlet, and a body extending therebetween. The compressor assembly further includes a non-rotating impeller shroud. The body and the shroud define an impeller chamber including a radially inner surface and a radially outer surface. The radially inner surface includes an arcuate flow surface. The flow surface includes a first portion and a second portion extending downstream from the first portion. The impeller chamber includes a variable area wherein a first cross-sectional area is defined between the radially outer surface and the first portion, and a second cross-sectional area is defined downstream from the first cross-sectional area. The first cross-sectional area is greater than the second cross-sectional area. A method of operating the compressor assembly is also included.

15 Claims, 2 Drawing Sheets

OTHER PUBLICATIONS

Pratt & Whitney Aircraft Division, United Aircraft Corporation, Florida Research and Development Center, West Palm Beach, Florida 33402, "Modified Centrifugal Compressor," Nov. 1974, 27 pgs. (a portion of).

Josuhn-Kadner, "Investigations on a Radial Compressor Tandem-Rotor Stage with Adjustable Geometry," Journal of Turbomachinery, Jul. 1993, pp. 552-559, vol. 115 (a portion of).

Honeywell Engines & Systems, General Electric Aircraft Engines, "Advanced High-pressure Compressor Stage for Gas Turbine Engines," BAA HPC Rig Test Final Review (U), Mar. 14, 2001, 8 pgs. (a portion of).

Douglas A. Roberts and Suresh C. Kacker, "Numerical Investigation of Tandem-Impeller Designs for a Gas Turbine Compressor, " Proceedings of ASME Turbo Expo, Jun. 4-7, 2001, New Orleans, Louisiana, USA, pp. 1-12 (a portion of).

* cited by examiner

ENGINE COMPRESSOR ASSEMBLY AND METHOD OF OPERATING THE SAME

BACKGROUND OF THE INVENTION

This invention relates generally to gas turbine engines and, more particularly, to gas turbine engine compressors.

At least some known gas turbine engines include a multi-stage axial compressor, a combustor, and a turbine. Airflow entering the compressor is compressed and channeled towards the combustor wherein the airflow is mixed with fuel and ignited, producing hot combustion gases used to drive the turbine. At least one known gas turbine engine includes a High Pressure Centrifugal Compressor (HPCC) that operates by inducing a centrifugal force to an air mass to achieve compression. Specifically, in at least some known gas turbine engines, the Centrifugal Compressor includes an impeller that is configured to add energy to the compressor and a diffusing system that is configured to convert a kinetic portion of the added energy into static pressure. In at least some known Centrifugal Compressors, the diffuser includes a radial diffuser, a bend, and a deswirler. In some known Centrifugal Compressors the radial diffuser, the bend, and the deswirler are made as an integral part.

At least one known gas turbine engine determines a centrifugal stage pressure ratio based on the impeller tip speed and basic geometric parameters, i.e., the blade exit, impeller tip height, back-sweep, the impeller inlet and exit radii, and an estimate of the impeller hub axial length. The maximum pressure ratio of known centrifugal compressors is generally limited by the highest tip speed allowed by its material properties and stall margins. For higher pressure ratios, known compressors use rearward-swept blades at the impeller exit to facilitate enhanced stall margin and operating efficiency. Specifically, to increasing compressor pressure ratio may require increasing both impeller tip speed and back-sweep to facilitate alleviating an impeller blade aerodynamic loading "diffusion", such that an efficiency is enhanced and a sufficient stall margin is secured.

BRIEF DESCRIPTION OF THE INVENTION

In one aspect, a method of operating a gas turbine engine is provided. The method includes channeling airflow towards an impeller including an inlet, an outlet, and a chamber extending therebetween, channeling airflow through the inlet into a flow path defined downstream from the inlet, and channeling airflow through the flow path wherein the flow path has a first cross-sectional area and a second cross-sectional area downstream from the first cross-sectional area wherein the second cross-sectional area is smaller than the first cross-sectional area.

In a further aspect, a compressor assembly for a gas turbine engine is provided. The compressor assembly includes a rotating impeller including an inlet, an outlet, and a body extending therebetween. The compressor assembly further includes a non-rotating impeller shroud. The body and the shroud define an impeller chamber including a radially inner surface and a radially outer surface. The radially inner surface includes an arcuate flow surface. The flow surface includes a first portion and a second portion extending downstream from the first portion. The impeller chamber includes a variable area wherein a first cross-sectional area is defined between the radially outer surface and the first portion, and a second cross-sectional area is defined downstream from the first cross-sectional area. The first cross-sectional area is greater than the second cross-sectional area.

In a further aspect, a gas turbine engine is provided. The gas turbine engine includes a rotor shaft, and a compressor assembly coupled to the rotor shaft. A compressor assembly for a gas turbine engine is provided. The compressor assembly includes a rotating impeller including an inlet, an outlet, and a body extending therebetween. The compressor assembly further includes a non-rotating impeller shroud. The body and the shroud define an impeller chamber including a radially inner surface and a radially outer surface. The radially inner surface includes an arcuate flow surface. The flow surface includes a first portion and a second portion extending downstream from the first portion. The impeller chamber includes a variable area wherein a first cross-sectional area is defined between the radially outer surface and the first portion, and a second cross-sectional area is defined downstream from the first cross-sectional area. The first cross-sectional area is greater than the second cross-sectional area.

DETAILED DESCRIPTION OF THE INVENTION

Figure 1:
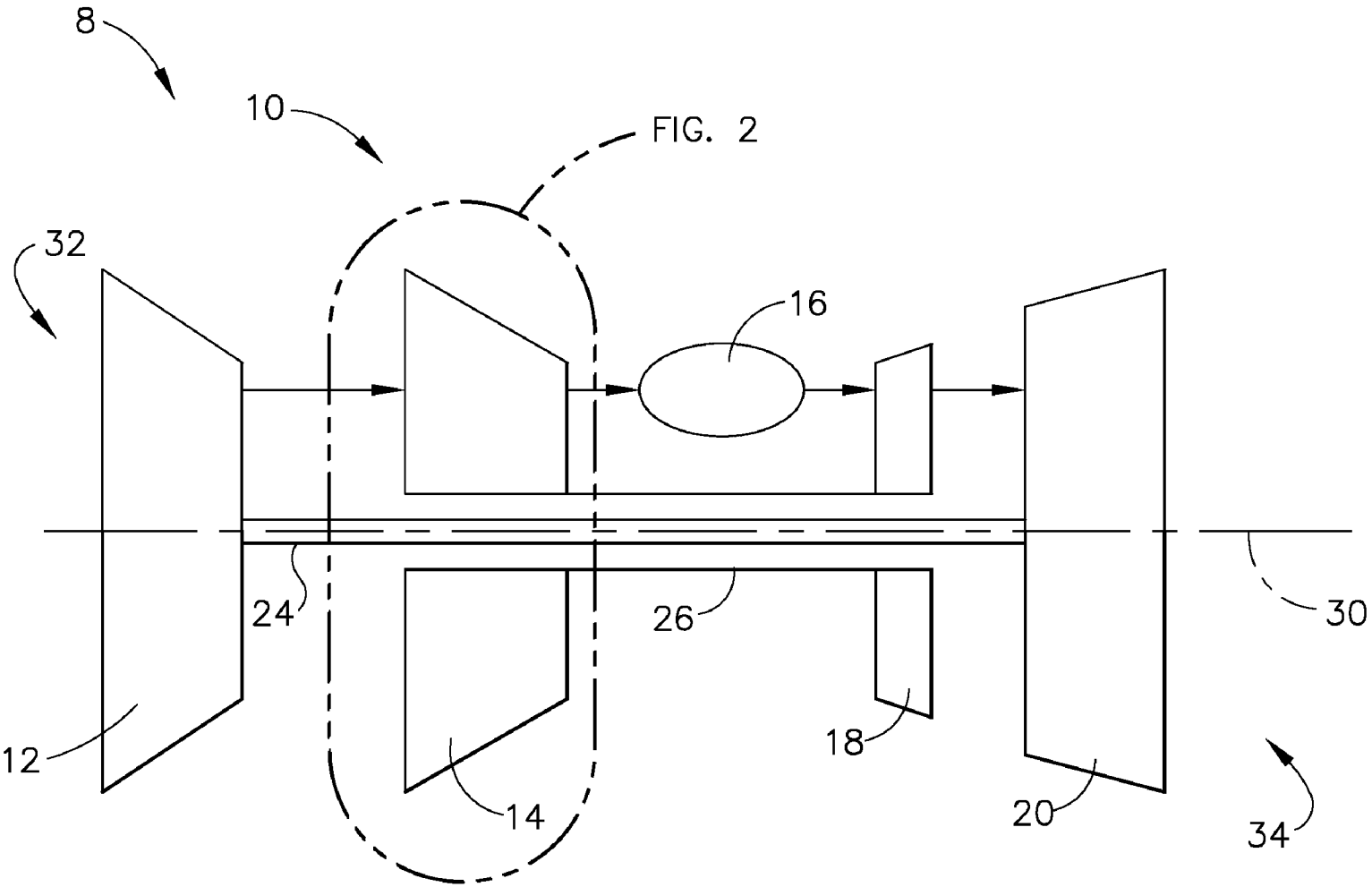
FIG. 1 is a schematic illustration of an exemplary gas turbine engine.

FIG. 1 is a schematic illustration of an engine assembly 8 that includes a core gas turbine engine 10 which in turn comprises a low pressure compressor 12, a high pressure compressor 14, a combustor 16, and a high-pressure turbine 18. Assembly 8 also includes a low pressure turbine 20 that is disposed axially downstream from core gas turbine engine 10. Compressor 12 and turbine 20 are coupled by a first shaft 24, and compressor 14 and turbine 18 are coupled by a second shaft 26. Engine 10 has an axis of symmetry 30 extending from an inlet side 32 of engine 10 aftward to an exhaust side 34 of engine 10. Shafts 24 and 26 rotate about axis of symmetry 30. In the exemplary embodiment, engine 10 is a T700/CT7 engine available from General Electric Aircraft Engines, Cincinnati, Ohio. In an alternative embodiment, engine 10 is any engine that is capable of operating, as described herein.

In operation, air flows through low pressure compressor 12 from an inlet side 32 of engine 10 and compressed air is supplied from low pressure compressor 12 to high pressure compressor 14. Compressed air is then delivered to combustor 16 and airflow from combustor 16 drives turbines 18 and 20.

Figure 2:
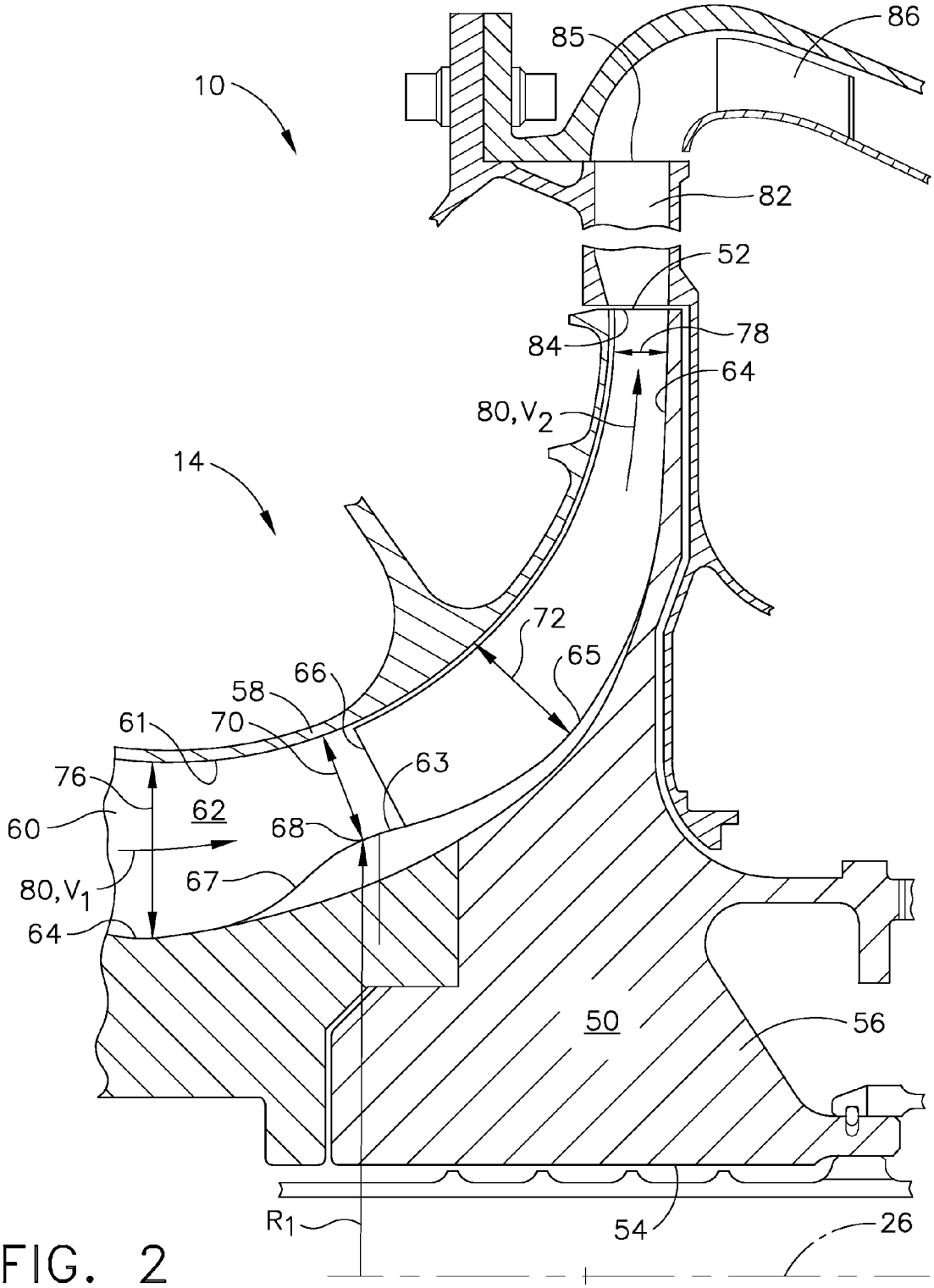
FIG. 2 is a cross-sectional illustration of a portion of the gas turbine engine shown in FIG. 1 taken along area 2.

FIG. 2 is a side cross-sectional schematic illustration of a portion of gas turbine engine 10 including a centrifugal compressor 14. Centrifugal compressor 14 includes an impeller 50 which includes a plurality of blades (not shown). In the exemplary embodiment, the blades can be a combination of full and partial (splitter) blades or two tandem rows of blades (as shown in FIG. 2) with moderate-to-high pressure ratio stages. In an alternative embodiment, the blades are tandem blades used with a tandem-bladed impeller. Impeller 50 extends aftward from compressor inlet 60 and downstream encompassing the blades, and includes an outlet 52, a hub 54, and a rotating body 56 that extends therebetween. Impeller 50 is bounded by a non-rotating shroud 58 defining its radially outer surface. In exemplary embodiment, impeller 50 is a tandem-bladed centrifugal impeller. In another embodiment impeller 50 is a combination of a full and partial (splitter) bladed body.

Impeller hub 54 extends circumferentially about rotor shaft 26. Body 56 and shroud 58 extend outwardly from an inlet 60 to outlet 52 in a frusto-conical shape. A chamber 62 is defined between body 56 and shroud 58. Chamber 62 includes a radially outer flow surface 61 that extends along a portion of shroud 58, and a radially inner flow surface 64, for example an arcuate flow surface, that extends along a portion of body 56. In the exemplary embodiment, radially inner flow surface 64 and radially outer flow surface 61 are used to describe the invention but should not limit the scope of the invention.

In the exemplary embodiment, flow surface 64 creates a convergent-divergent flow path 67 through the impeller. Specifically, flow path 67 is formed integrally with flow surface 64. Flow path 67 includes a first portion 63, and a second portion 65 that extends continuously downstream from first portion 63. In the exemplary embodiment, first portion 63 and second portion 65 are formed integrally. A leading edge 66 of a splitter is defined between first portion 63 and second portion 65. In the an exemplary embodiment, first portion 63 and second portion 65 are designed independently subject to a common interface, for example, the outlet of first portion 63 is the inlet to second portion 65. First portion 63 is designed according to fan technology knowledge and second portion 65 is designed according to centrifugal compressor technology knowledge. In this embodiment the common interface approximately defines a location of the splitter leading edge, such that starting point for an integrally optimized flow path is defined. In the exemplary embodiment, first portion 63 extends upstream from leading edge 66 towards impeller inlet 60, and second portion 65 extends downstream from leading edge 66 towards impeller outlet 52. Moreover, in the exemplary embodiment, first portion 63 includes an apex 68 such that apex 68 is upstream from leading edge 66. After an aerodynamic optimization subject to design requirements and constraints, the splitter leading edge may be on either side of the apex 68.

In the exemplary embodiment, the cross-sectional area of flow path 67 defined within chamber 62 is variable along the length of the impeller body 56. Specifically, in the exemplary embodiment, chamber 62 has a first cross-sectional area 70 defined between flow path first portion 63 and surface 61 at apex 68. As such, an inflection point where a rate of area change from the upstream part to the downstream part is substantially decreased. Chamber 62 has a second cross-sectional area 72 defined downstream from apex 68. Specifically, second cross-sectional area 72 is defined between flow path second portion 65 and surface 61. Second cross-sectional area 72 is smaller than cross-sectional area 70 and represents the beginning of the lower rate of area decrease region. Moreover, impeller inlet 60 has a cross-sectional area 76 defined between surface 61 and flow path 67, and upstream from first portion 63.

In the exemplary embodiment, impeller outlet 52 has a cross-sectional area 78 defined between surfaces 61 and 64. In the exemplary embodiment, cross-sectional area 78 is smaller than cross-sectional areas 70, 72, and 76. More specifically, flow path 67 defined within impeller chamber 62 is generally tapered inwardly in the direction of the flow. First portion 63 is tapered from apex 68 downstream towards inlet 60. Second portion 65 is tapered inwardly from apex 68 downstream towards outlet 52.

A diffuser 82 is coupled in flow communication to impeller outlet 52 such that airflow exiting chamber 62 is channeled through diffuser 82. Diffuser 82 is coupled radially outward from impeller 50 and includes an inlet 84 and an outlet 85. A deswirl cascade 86 is in flow communication with diffuser 82 and extends from diffuser outlet 85.

During assembly of impeller 50, impeller hub 54 is coupled circumferentially about rotor shaft 26. Body 56 and shroud 58 extend radially outward from inlet 60 to outlet 52. In the exemplary embodiment, radially inner flow surface 64 and flow path 67 are formed integrally with body 56. Impeller 50 and flow path 67 are constructed using hybrid Fan-Centrifugal technology. Impeller 50 is designed through an iterative process wherein detailed geometry is generated, analyzed in a quasi-2D flow solver, and further analyzed with a Computational Fluid Dynamics (CFD) code. In one embodiment, the CFD code is based on a numerical scheme based on, for example, pressure correction versus explicit and implicit time marching. In the exemplary embodiment, the CFD code that is used is immaterial. The CFD solution is analyzed to ensure that the target performance parameters are met. The process is repeated until all aerodynamic requirements are satisfied and the impeller flow path 67 is generated.

In the exemplary embodiment, surface 64 is created with first portion 63, second portion 65, and apex 68. Apex 68 is designed with a higher rate of radius $R_1$ increase in the first portion 63 in comparison to known impeller flow paths. A higher rate of radius facilitates increasing the centrifugal action of impeller 50, and thus facilitates a more uniform total pressure distribution at impeller outlet 52. Flow path 67 facilitates optimizing a rate of meridional area convergence within impeller 50.

In the exemplary embodiment, the impeller work input that produces the required pressure ratio is known to be the product of the wheel linear metal speed and the air, or fluid, turning in the tangential direction. The wheel linear metal speed is the radius multiplied rotational speed. This physical law applies locally as well globally (i.e. on an average basis from inlet to exit). A higher air, or fluid, turning is a result of a higher blade curvature. The increased curvature produces a higher adverse pressure gradient (diffusion) that the flow may not be able to sustain, causing flow-separation. The flow separation may be local or global. If the flow separation is global it may be massive and extend to the exit. Flow separation is known to reduce both efficiency and stall margin (safe operating flow range at speed). Increasing the wheel speed reduces blade curvature for given required work input, and consequently reduces the risk of flow separation.

Referring to FIG. 2, the radius of flow surface 61 is substantially greater than the radius of flow path 67. This is particularity noted at the impeller inlet region. Thus, blade curvatures increase from shroud-to-hub to secure uniform work input rate. In the exemplary embodiment, the hub blade curvature can be excessive, consequently increasing the impeller tip speed (lengthening the flow path to re-distribute hub region blade curvature) or sacrificing efficiency and stall margin.

As such, the present invention offers a method by which to improve the blade hub region curvature and improve efficiency and stall margin. Additionally, the present invention improves the mechanical aspects & complexity of the resulting impeller blade. Also, reduction of impeller size implies smaller associate frontal area and engine weight.

During operation, in the exemplary embodiment, inlet air 80 enters compressor 12 (shown in FIG. 1) and is compressed prior to entering impeller 50. Compressed inlet air 80 entering impeller chamber 62 then is channeled through impeller 50 before being discharged from impeller outlet 52.

In the exemplary embodiment, flow path 67 creates a venturi flow path, as is described in detail herein, into air flowing through impeller 50. More specifically, the absolute velocity of airflow 80 exiting chamber 62 is greater than the velocity of airflow 80 entering chamber 62 (relative to the rotor, i.e. the relative velocities behave the opposite from the absolute velocities). In the exemplary embodiment, inlet air 80 enters impeller chamber 62 through inlet 60 at a first absolute velocity V1 within flow path area 76. The air 80 that is channeled downstream through chamber 62 is channeled through a reduced cross-sectional area 70. Thus, the velocity of air 80 is increased to a second absolute velocity V2 at outlet 52. In the exemplary embodiment, second absolute velocity V2 is greater than first absolute velocity V1.

After air 80 flows through chamber 62, air 80 exits chamber 62 through outlet 52 and flows into diffuser 82. Air 80 further passes through deswirler cascade 86 into combustor casing (not shown) where it is mixed with fuel provided by fuel nozzles and ignited within an annular combustion zone to produce hot combustion gases. The resulting hot combustion gases drive turbines 18 and 20.

A method of operating a gas turbine engine is described herein. The method includes channeling airflow towards an impeller including an inlet, an outlet, and a chamber extending therebetween, channeling airflow through the inlet into a flow path defined downstream from the inlet, and channeling airflow through the flow path wherein the flow path has a first cross-sectional area at a first location and a second cross-sectional area downstream from the first cross-sectional area wherein the second cross-sectional area is smaller than the first cross-sectional area.

Described herein is a flow surface for an impeller that may be utilized on a wide variety of turbofan, turbo-shaft, and turbo-prop engine assemblies for use with an aircraft and/or an industrial application which uses medium to high pressure ratios centrifugal compressors, e.g. turbo-chargers. The impeller chamber and flow surface have a first cross-sectional area that is larger than a second cross-sectional area defined downstream from the first cross-sectional area. The flow surface described herein improves engine performance by increasing the centrifugal action, and produces a more uniform total pressure distribution at the outlet of the impeller increasing engine efficiency.

An exemplary embodiment of an impeller for an engine assembly is described above in detail. The assembly illustrated is not limited to the specific embodiments described herein, but rather, components of each assembly may be utilized independently and separately from other components described herein.

The above-described compressor describes a contoured surface of an impeller that is cost-effective and increases the absolute velocity and static pressure of airflow exiting the impeller.

While the invention has been described in terms of various specific embodiments, those skilled in the art will recognize that the invention can be practiced with modification within the spirit and scope of the claims.

What is claimed is:

1. A method of operating a gas turbine engine, said method comprising:

channeling airflow towards an impeller of a centrifugal compressor that includes an axially oriented inlet, a radially oriented outlet, and a chamber extending therebetween, wherein the direction of airflow in the chamber changes from an axial flow at the inlet to a radially outward flow at the outlet;

channeling airflow through the impeller inlet into a convergent-divergent flow path defined within the impeller chamber downstream from the inlet;

channeling airflow from a third cross-sectional area defined upstream from a first cross-sectional area, said third cross-sectional area is larger than said first cross-sectional area; and channeling airflow from said first cross-sectional area of the flow path into a second cross-sectional area of the flow path defined downstream from the first cross-sectional area, wherein the second cross-sectional area is smaller than the first cross-sectional area.

2. A method in accordance with claim 1 further comprising channeling airflow through the inlet at a first velocity.

3. A method in accordance with claim 2 wherein said method further comprises channeling airflow through the outlet at a second absolute velocity that is of greater magnitude than the first absolute velocity.

4. A centrifugal compressor assembly for a gas turbine engine, said centrifugal compressor assembly comprising:

a rotating centrifugal impeller comprising an axially-oriented inlet, a radially-oriented outlet, and a body extending therebetween; and a non-rotating impeller shroud, said body and said shroud define an impeller chamber comprising a radially inner surface and a radially outer surface, said radially inner surface comprises an arcuate, convergent-divergent flow surface, said flow surface comprises a first portion and a second portion extending downstream from said first portion, said impeller chamber comprising a variable area wherein a first cross-sectional area is defined between said radially outer surface and said first portion, and a second cross-sectional area is defined downstream from said first cross-sectional area, said first cross-sectional area is greater than said second cross-sectional area, said impeller chamber further comprises a third cross-sectional area defined upstream from said first cross-sectional area, said third cross-sectional area is larger than said first cross-sectional area, wherein the direction of airflow in said impeller chamber changes from an axial flow at the inlet to a radially outward flow at the outlet.

5. A compressor assembly in accordance with claim 4 wherein said second cross-sectional area is defined between said radially outer surface and said second portion.

6. A compressor assembly in accordance with claim 4 wherein said first portion is formed integrally with said second portion.

7. A compressor assembly in accordance with claim 4 wherein said first portion is formed integrally with said second portion and said impeller body.

8. A compressor assembly in accordance with claim 4 wherein said flow path further comprises an apex defined between said first portion and said second portion.

9. A compressor assembly in accordance with claim 4 wherein a leading edge of a splitter is defined between said first portion and said second portion.

10. A gas turbine engine comprising:

a rotor shaft; and a centrifugal compressor assembly coupled to said rotor shaft, said centrifugal compressor assembly comprising a rotating impeller comprising an axially-oriented inlet, radially-oriented outlet, and a body extending therebetween, and a non-rotating impeller shroud, said body and said shroud define an impeller chamber comprising a radially inner surface and a radially outer surface, said radially inner surface comprises an arcuate, convergent-divergent flow surface, said flow surface comprises a first portion and a second portion extending downstream from said first portion, said impeller chamber comprising a variable area wherein a first cross-sectional area is defined between said radially outer surface and said first portion, and a second cross-sectional area is defined downstream from said first cross-sectional area, said first cross-sectional area is greater than said second cross-sectional area, said impeller chamber further comprises a third cross-sectional area defined upstream from said first cross-sectional area, said third cross-sectional area is larger than said first cross-sectional area wherein the direction of airflow in said impeller chamber changes from an axial flow at the inlet to a radially outward flow at the outlet.

11. A gas turbine engine in accordance with claim 10 wherein said second cross-sectional area is defined between said radially outer surface and said second portion.

12. A gas turbine engine in accordance with claim 10 wherein said first portion is formed integrally with said second portion.

13. A gas turbine engine in accordance with claim 10 wherein said first portion is formed integrally with said second portion and said impeller body.

14. A gas turbine engine in accordance with claim 10 wherein said flow path further comprises an apex defined within said first portion.

15. A gas turbine engine in accordance with claim 10 wherein a leading edge of a splitter is defined between said first portion and said second portion.

* * * * *